US005705781A

United States Patent [19]

Habedank et al.

[11] Patent Number: 5,705,781

[45] Date of Patent: Jan. 6, 1998

[54] ELECTRICAL GAS-BLAST SWITCH

[75] Inventors: Ulrich Habedank; Klaus-Peter Rolff, both of Berlin, Germany

[73] Assignee: Siemens Aktiengesellschaft, Munich, Germany

[21] Appl. No.: 646,303

[22] PCT Filed: Oct. 27, 1994

[86] PCT No.: PCT/DE94/01296

§ 371 Date: Jul. 19, 1996

§ 102(e) Date: Jul. 19, 1996

[87] PCT Pub. No.: WO95/14302

PCT Pub. Date: May 26, 1995

[30] Foreign Application Priority Data

Nov. 19, 1993 [DE] Germany ..... 43 39 925.8

[51] Int. Cl.[6] ..... H01H 33/88; H01H 33/915

[52] U.S. Cl. ..... 218/59; 218/57; 218/62; 218/78

[58] Field of Search ..... 218/57–67, 43, 218/78

[56] References Cited

U.S. PATENT DOCUMENTS

| | | | |
|---|---|---|---|
| 3,590,188 | 6/1971 | Frink et al. | 218/43 |
| 3,621,171 | 11/1971 | Yoshioka | 218/57 |
| 3,902,031 | 8/1975 | McConnell | 218/62 |
| 4,041,263 | 8/1977 | Noeske | 218/60 |
| 4,438,308 | 3/1984 | Körner et al. | 218/59 |
| 4,511,775 | 4/1985 | Korner et al. | 218/57 |
| 4,524,257 | 6/1985 | Slamecka | 218/59 |
| 4,553,004 | 11/1985 | Thuries | 218/59 |
| 5,285,036 | 2/1994 | Lorenz | 218/61 |

FOREIGN PATENT DOCUMENTS

| | | | |
|---|---|---|---|
| 2 542 499 | 9/1984 | France | H01H 33/91 |
| 26 18 087 | 2/1977 | Germany | H01H 33/91 |
| 31 41 324 | 3/1983 | Germany | H01H 33/91 |
| 40 10 006 | 10/1991 | Germany | H01H 33/70 |
| 40 10 007 | 10/1991 | Germany | H01H 33/70 |

*Primary Examiner*—J. R. Scott
*Attorney, Agent, or Firm*—Kenyon & Kenyon

[57] ABSTRACT

In a gas-blast switch with a compression device to produce a quenching gas blast, in order to make the magnetic effect of the break current available already at the beginning of the cut-off movement, a compression chamber and a piston-cylinder system form an energy accumulator. A movable element of the piston-cylinder system is mechanically linked with an armature, which is axially moved by the magnetic field of a stator, which field is excited by the break current. The armature and the stator are arranged in such a way that the magnetic field already causes the armature to move.

5 Claims, 2 Drawing Sheets

ELECTRICAL GAS-BLAST SWITCH

FIELD OF THE INVENTION

The present invention relates to an electrical gas-blast switch.

BACKGROUND INFORMATION

German Patent Application Nos. 40 10 006 and 40 10 007 describe gas-blast switches which include a switching piece which can be moved by a drive, which connects a fixed contact piece with a connector piece through which load current flows in the cut-in state (cut-in position). The compression device in such gas-blast switches includes a compression piston and a compression cylinder which enclose a compression space. During the cut-off process, the piston and the cylinder are moved relative to one another. Any quenching gas located in the compression space is thus compressed, and serves to blast the arc which occurs when the switching piece moves away from the contact piece. $SF_6$, for example, is used as the quenching gas. In order to utilize the magnetic effect of the cut-off or short-circuit current to support the drive, the contact arrangement is partially surrounded by a stator which consists of ferromagnetic material and has at least one continuous slit. The compression cylinder shown in German Application No. 40 10 006 or the compression piston shown in German Application No. 40 10 007 each has at least one rod-shaped armature. Only after a partial movement of the compression cylinder during the cut-off process does the armature get into the region of influence of the magnetic field of the stator excited by the break current, which draws the armature into the slit of the stator, supporting the drive. The drive-supporting axial movement of the armature, which does not start until after the beginning of the compression cylinder movement, is therefore not available for the initial acceleration of the compression cylinder.

In another known gas-blast switch illustrated in German Patent No. 31 41 324, the rated current flows via the compression cylinder. During the cut-off process, the break current commutates to a gradient coil after a certain movement distance of the cylinder, and causes the movement of a ring piston which directly supports the arc blasting.

Another gas-blast switch is described in U.S. Pat. No. 4,438,308 which describes a gas-blast switch in which an auxiliary blast effect due to contraction of the spring windings as a result of the break current only starts after the compression cylinder has been significantly moved by a drive.

SUMMARY OF THE INVENTION

The present invention provides a gas-blast switch which includes a contact arrangement which includes a fixed contact piece, a connector piece and a switching piece which can be moved by a drive, with a compression device to produce a blast of quenching gas. The gas-blast switch also includes a compression piston and a compression cylinder which can be moved relative to one another by the drive during the cut-off process, starting from a cut-in position, and a stator which can be excited by the break current, the magnetic field of which causes a drive-supporting axial movement of at least one armature.

An object of the present invention is to provide a gas-blast switch in which the magnetic effect of the break current is already almost completely available, particularly at the beginning of the cut-off movement of the compression cylinder, and which allows a rapid switching movement with a comparatively slight necessary drive power.

The aforementioned object is accomplished according to the present invention with a gas-blast switch having an energy accumulator in the form of a compression chamber where a piston/cylinder system is provided, the movable element of which is mechanically linked with the armature. The armature and the stator are arranged in such a way that the magnetic field already causes the armature to move in the cut-in position, and that the energy accumulator is arranged in such a way that discharge of the energy accumulator acts to support the drive. The (short-circuit) current, which is significantly increased, for example, in case of a short-circuit, causes an armature movement even before the gas-blast switch is triggered and before the switching piece and the compression cylinder start to move, resulting in a volume reduction of the compression chamber. The compression cylinder therefore forms a pneumatic energy accumulator. A significant advantage of the present invention consists of the fact that the energy accumulator is charged even before the switch is triggered, so that the energy accumulated at the time of triggering is completely available to support the drive. The acceleration energy required for the moving switch parts at the beginning of the cut-off process can be advantageously made available by the energy accumulator, for the most part, so that the drive can be cost-effectively sized for a comparatively low total power. The switch according to the present invention can switch relatively quickly.

In another embodiment of the present invention, the energy accumulator is arranged within the compression cylinder.

Yet in another embodiment of the present invention, the energy accumulator is arranged within the connector piece and the side of the compression chamber which faces away from the contact arrangement formed by a power take-off piston which is mechanically linked with the drive. With this structure of the present invention, the armature can serve directly as a drive piston of the compression chamber. For advantageous adaptation to the necessary stroke and force requirement, the drive piston and the power take-off piston can have different cross-sections. Therefore the compression chamber advantageously forms a stroke and force converter.

To increase the magnetic flux and thereby increase the utilization of the magnetic effect of the break current, still another embodiment of the present invention provides that the stator is a coil. A preferred embodiment of the present invention includes the coil consisting of a segment of the connector piece, the wall of which having a radial slit wound like a screw passing through it.

DETAILED DESCRIPTION

Figure 1:
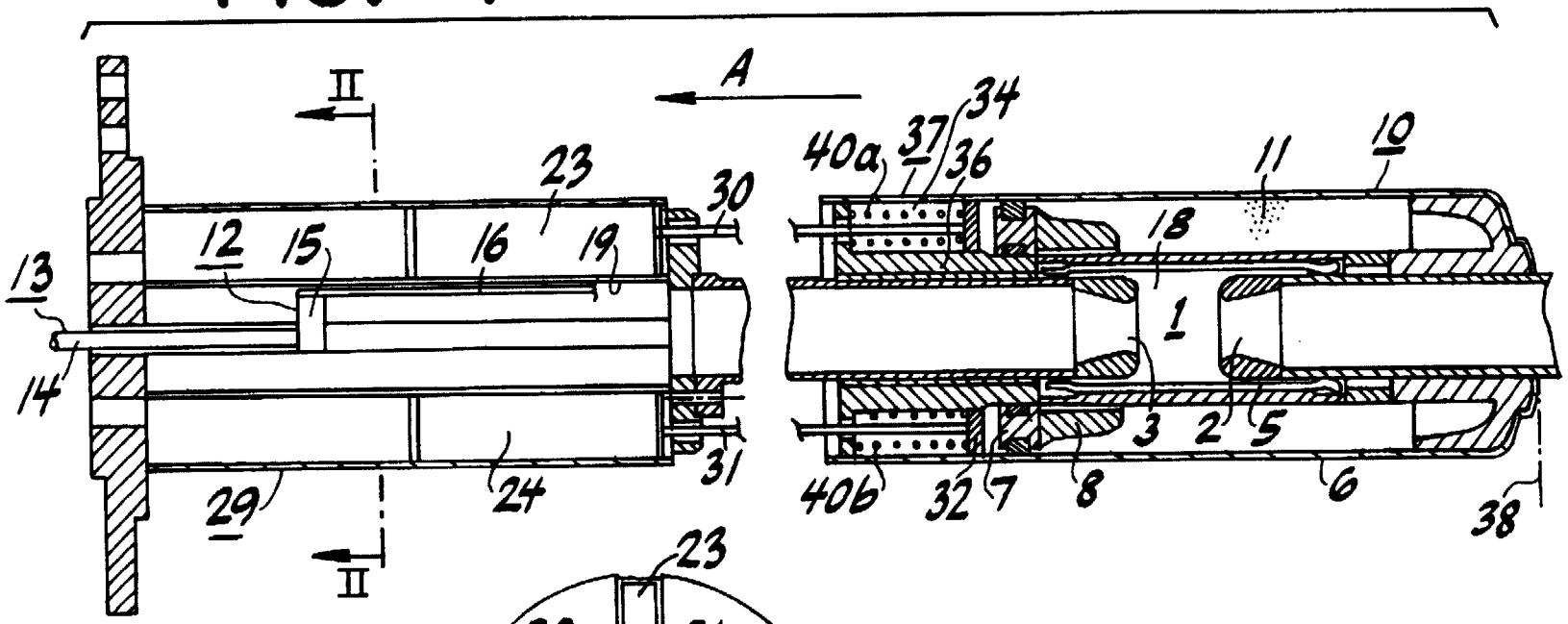
FIG. 1 shows a first embodiment of a gas-blast switch according to the present invention in the cut-in position.
Figure 2:
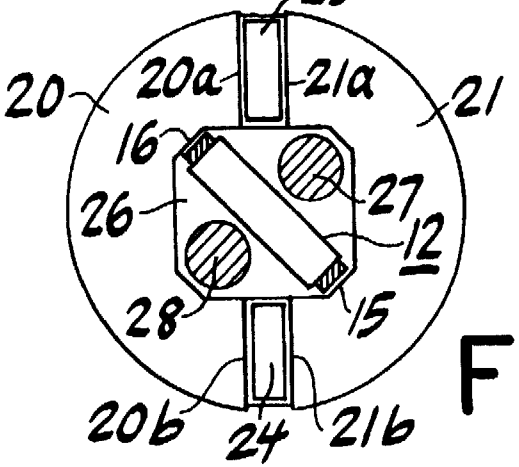
FIG. 2 shows a cross-section along line II—II in FIG. 1.

As shown in FIG. 1, a gas-blast switch in accordance with a present invention has a contact arrangement 1 with a fixed contact piece 2, a connector piece 3 which lies coaxially opposite the fixed contact piece 2, through which load current flows, and a movable switching piece 5. The movable switching piece 5 is rigidly connected with a compression cylinder 6. The compression cylinder 6, together with a fixed compression piston 7 and a filler element 8, forms a mechanical compression device 10 for a quenching gas 11. The compression cylinder 6 is connected with a mechanical drive 13, via a switching rod 16 (which is not shown with detail.) Parts of a rod 14 and a fork 15 are shown in FIG. 1. The connector piece 3, towards which the compression cylinder 6 moves during a cut-off movement, in the direction of the arrow A, is surrounded by two approximately semi-circular yokes 20 and 21, approximately 90 mm high (FIG. 2). Guide shafts are formed between their pole surfaces 20*a*, 20*b* and 21*a*, 21*b* which hold two armatures 23 and 24. Two conductors 27, 28 through which the rated current, i.e. the break current flows in the same direction, are arranged in the center region 26 of the yokes 20 and 21. This arrangement, together with the yokes 20 and 21, forms a stator 29 for the armatures 23 and 24.

The armatures 23 and 24 are connected with a ring piston 32 via connecting rods 30 and 31. The piston 32 delimits a compression chamber 34, which is closed off by the compression cylinder 6 on the outside and by a guide part 36 on the inside and the bottom. The piston/cylinder system 32, 36, 6 forms a pneumatic energy accumulator 37. FIG. 1 illustrates the gas-blast switch in the "cut-in position" 38.

If a short-circuit occurs, the load current (short-circuit current) increases before the switch is triggered, to the point that a magnetic field of the stator 29 is formed which is strong enough so that the armatures 23 and 24 come into its region of effect and are pulled between the guide shafts (pole surfaces) 20*a*, 21*a* and 20*b*, 21*b* of the stator 29. The piston 32 which is rigidly connected with the armatures 23 and 24 via the connecting rods 30 and 31 is accordingly moved in the direction of the arrow A, compressing the quenching gas located in the compression chamber 34. The movement of the piston 32 ends before the switch is triggered, i.e. before the compression cylinder 6 is released and moved in the direction of the arrow A by the drive 12, via the switching rod 16. At the beginning of the cut-off movement of the compression cylinder, the pneumatic energy stored in the compression chamber 34 is therefore available. The compression chamber excess pressure, which has a strong drive-supporting effect during the initial movement (acceleration) of the compression cylinder 6 and any other switch parts, acts on the bottom region of the guide part 36, so that rapid switching is possible with a relatively low drive power.

In order to bring the piston 32 back into its initial position after the cut-off process, when current cut-in occurs again, positioning pressure springs 40*a*, 40*b* surround the connecting rods 30, 31.

Figure 3:
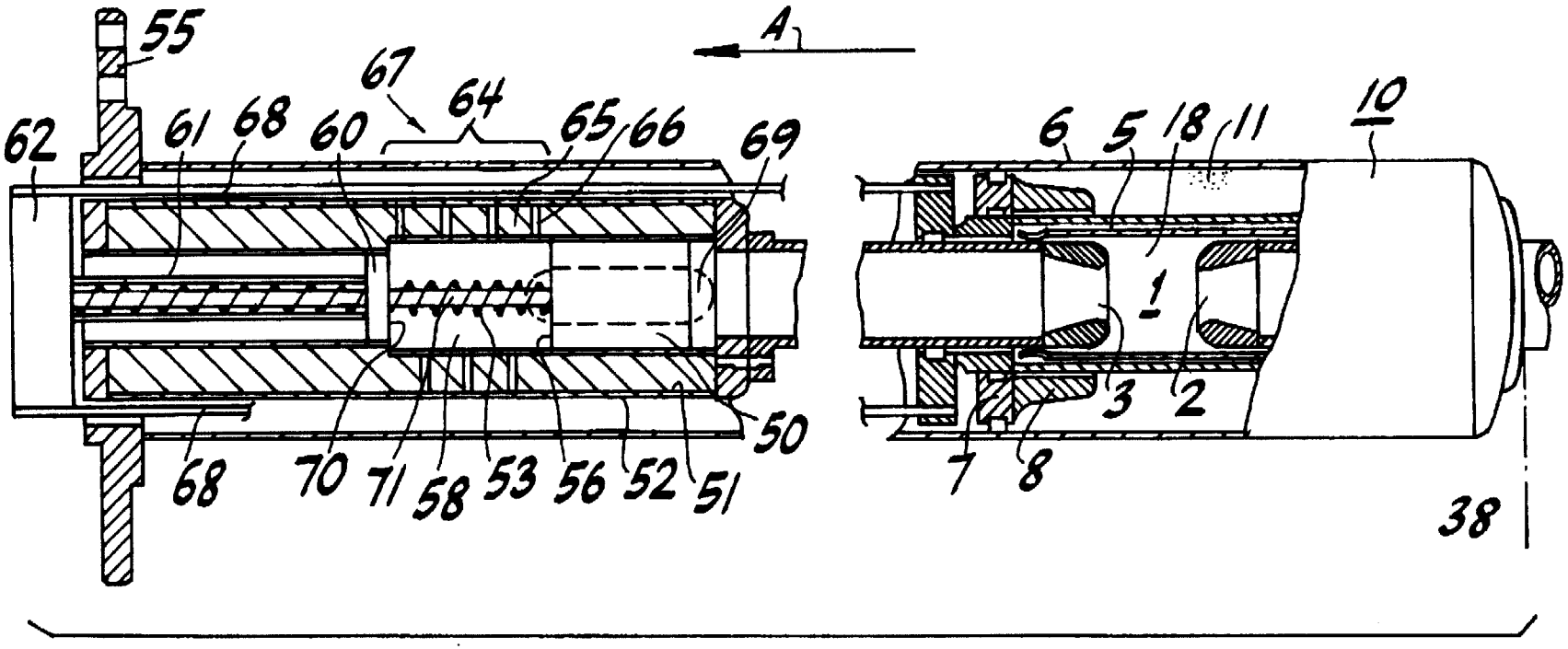
FIG. 3 shows another embodiment of the gas-blast switch according to the present invention.

FIG. 3 shows another embodiment of a gas-blast switch according to the present invention which is modified with regard to the armature arrangement and the stator. The gas-blast switch is shown in FIG. 3 in the cut-in position 38. An armature 50 is movable in the direction of a rear flange 55, inside a guide tube 52 which is lined with insulation material 51, counter to the force of a positioning spring 53. With its end 56, the armature 50 delimits a compression chamber 58, the mantle of which is surrounded by the insulation material 51 and a back part 59 of the connector piece 3. The other end of the compression chamber 58 is delimited by a drive piston 60 which is mechanically linked with a fork 62 via a tube 61. A segment 64 substantially near the back end 59 of the connector piece 3 forms a coil 65 which surrounds the compression chamber 58, in that the wall of the segment 64 has a continuous radial slit 66 wound like a screw passing through it. The windings are well insulated from one another electrically.

A break current which flows through the coil 65 produces a magnetic field in the stator 67 formed by the coil 65, which moves the armature 50 towards the flange 55, in the direction of the arrow A. This causes quenching gas contained in the compression chamber 58 to be compressed. The compression chamber 58 acts as an energy accumulator and passes the accumulated energy on to the fork 62 via the drive piston 60. The time of energy release can be determined by means of a corresponding release of the drive, and can be coordinated with the movement of the compression cylinder 6 caused by the drive (not shown) via the fork 62 and the connecting rods 68. An opening 69 serves as an exit for quenching gas during the movement of the compression cylinder 6.

The gas-blast switch of the present invention as shown in FIG. 3 not only allows a controllable use of the energy obtained and accumulated from the break current, but also provides a particularly compact arrangement of the compression chamber, which is particularly suitable for use of a coil as the stator. By means of the design of the pressure-influenced surface 56 of the armature 50 and the surface 70 of the drive piston 60, optimal adaptation of the drive support to the stroke and force requirement is possible. Furthermore, it can be provided that the armature 50 be interconnected in such a way that the catch can only be released again in the cut-in position of the switch. The release can take place via a guide rod 71 of the positioning spring 53. This can be used to prevent the compression chamber 58 from acting counter to the cut-in movement during cut-in in response to a short-circuit.

We claim:

1. An electrical gas-blast switch comprising:

a contact device including a fixed contact piece, a connector piece and a switching piece, the switching piece electrically connecting the fixed contact piece to the connector piece in a contact making position;

a compression device for generating a blast of a quenching gas, the compression device including a compression piston and a compression cylinder;

an armature;

a stator for generating a magnetic field for causing an axial movement of the armature; and an energy accumulator including a first compression chamber and a piston-cylinder system, the piston-cylinder system including a first movable element mechanically coupled to the armature and a second movable element mechanically coupled to the switching piece, wherein the armature and the stator are arranged to so that the magnetic field causes the armature to move into a cut-in position, and wherein the energy accumulator is discharged to support the movement of the second element and the movement of the switching system.

2. The gas-blast switch according to claim 1, wherein the energy accumulator is positioned within the compression cylinder.

3. The gas-blast switch according to claim 1, wherein the energy accumulator is positioned within the connector piece, and wherein gas-blast switch further comprises a power take-off piston, the power take-off piston forming the second moving element and being positioned on a side of the piston-cylinder system opposite to the switching piece.

4. The gas-blast switch according to claim 3, wherein the stator is a coil.

5. The gas-blast switch according to claim 4, wherein the coil includes a segment of the connector piece, the segment including a wall having a radial slit, the radial slit being wound helically through the wall.

* * * * *